US005544885A

United States Patent [19]

Besnard et al.

[11] Patent Number: 5,544,885

[45] Date of Patent: Aug. 13, 1996

[54] IRON WITH IMPROVED MASS DISTRIBUTION

[75] Inventors: Philippe Besnard, Yverdon, Switzerland; Larry Tang, Casabasa, Calif.; Richard L. Rugge, Encinitas, Calif.; Jim Sieleman, San Diego, Calif.; Franck Dumontier, Vista, Calif.

[73] Assignee: Taylor Made Golf Co., Inc., Carlsbad, Calif.

[21] Appl. No.: 521,733

[22] Filed: Aug. 31, 1995

[51] Int. Cl.[6] ..... A63B 53/04

[52] U.S. Cl. ..... 473/350

[58] Field of Search ..... 273/167 R–77 A, 273/193 R, 194 R, 187.4, 186.2, 78; D21/220; 473/349, 350

[56] References Cited

U.S. PATENT DOCUMENTS

| | | | |
|---|---|---|---|
| D. 115,216 | 6/1939 | Newsome . | |
| D. 137,813 | 5/1944 | Newsome . | |
| D. 141,307 | 5/1945 | Newsome . | |
| D. 186,986 | 1/1960 | Long . | |
| D. 203,936 | 3/1966 | Long . | |
| D. 244,703 | 6/1977 | Guzzle | 273/167 D |
| D. 321,920 | 11/1991 | Parente et al. | D21/220 |
| D. 339,183 | 9/1993 | Stites, III | D21/220 |
| D. 345,775 | 4/1994 | Poincenot et al. | D21/220 |
| D. 353,862 | 12/1994 | Saito | D21/220 |
| 1,671,956 | 5/1928 | Sime | 273/167 A |
| 3,059,926 | 10/1962 | Johnstone | 273/77 A |
| 3,814,437 | 6/1974 | Winquist | 273/167 H |
| 3,995,858 | 12/1976 | Cochran | 273/77 A |
| 4,420,156 | 12/1983 | Campau | 273/77 A |
| 4,715,601 | 12/1987 | Lamanna | 273/77 A |
| 5,011,151 | 4/1991 | Antonious | 273/167 H |
| 5,014,993 | 5/1991 | Antonious | 273/169 |
| 5,046,733 | 9/1991 | Antonious | 273/167 H |
| 5,048,835 | 9/1991 | Gorman | 273/167 H |
| 5,074,563 | 12/1991 | Gorman | 273/167 H |
| 5,082,278 | 1/1992 | Hsien | 273/164.1 |
| 5,242,167 | 9/1993 | Antonious | 273/167 F |
| 5,282,625 | 2/1994 | Schmidt et al. | 273/167 H |
| 5,292,122 | 3/1994 | Solheim | 273/77 A |
| 5,333,872 | 8/1994 | Manning | 273/167 F |
| 5,377,985 | 1/1995 | Ohnishi | 273/167 F |

OTHER PUBLICATIONS

Austad's 1985 Golfer's Get Acquainted Catalog, p. 5.
Golf Day Early Summer 1991 catalog p. 22.
Edwin Watts Golf Shops 1992 catalog, p. 11.
*Golf Digest,* Feb. 1991, p. 34.
*Golf,* Jul. 1987, p. 69.
*Golf Digest,* Jul. 1987, p. 7.
*Golf Equipment,* 1976, p. 16.

*Primary Examiner*—Sebastiano Passaniti
*Attorney, Agent, or Firm*—Greenblum & Bernstein P.L.C.

[57] ABSTRACT

The invention is directed to a golf club of the iron type having an improved mass distribution. More particularly, the rear portion of the club head has a main cavity extending towards the striking face and a peripheral mass belt extending around the main cavity defining heel, toe, upper and lower perimeter portions. The upper perimeter portion of the peripheral mass belt includes a secondary recess which has a volume smaller than the volume of the main cavity and a volume per unit length that increases in a direction toward the toe of the club head.

11 Claims, 3 Drawing Sheets

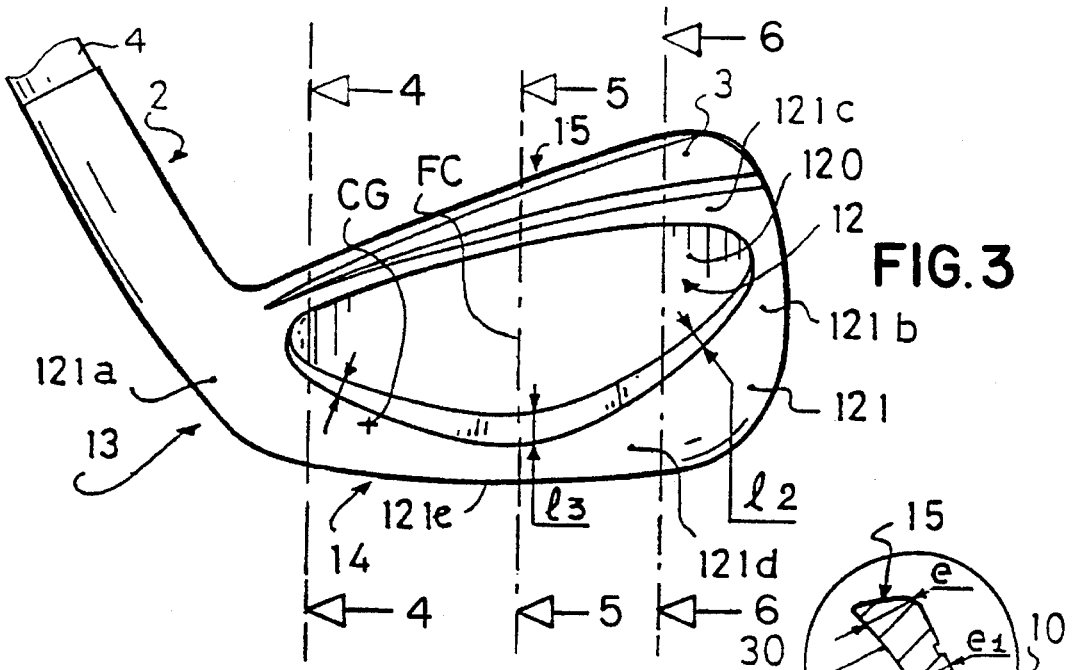
FIG.3
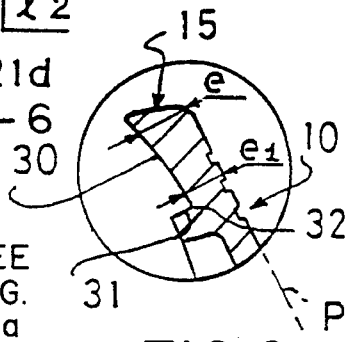
FIG.6
FIG.6a
FIG.5
FIG.4
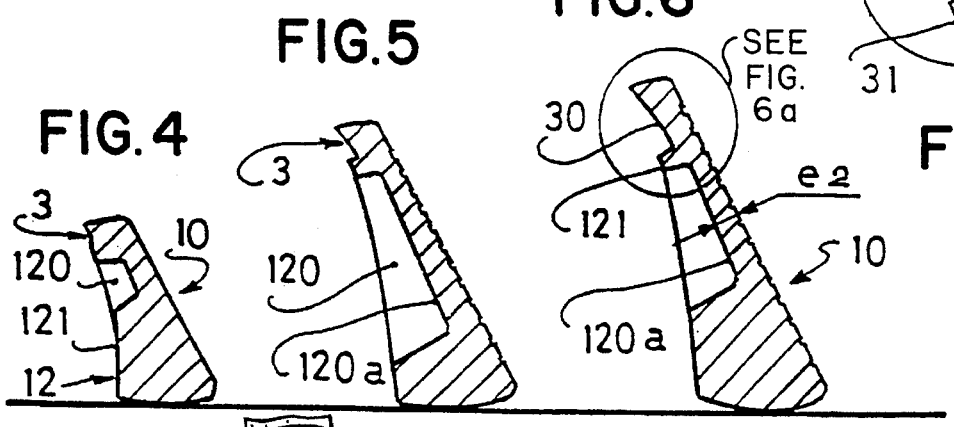
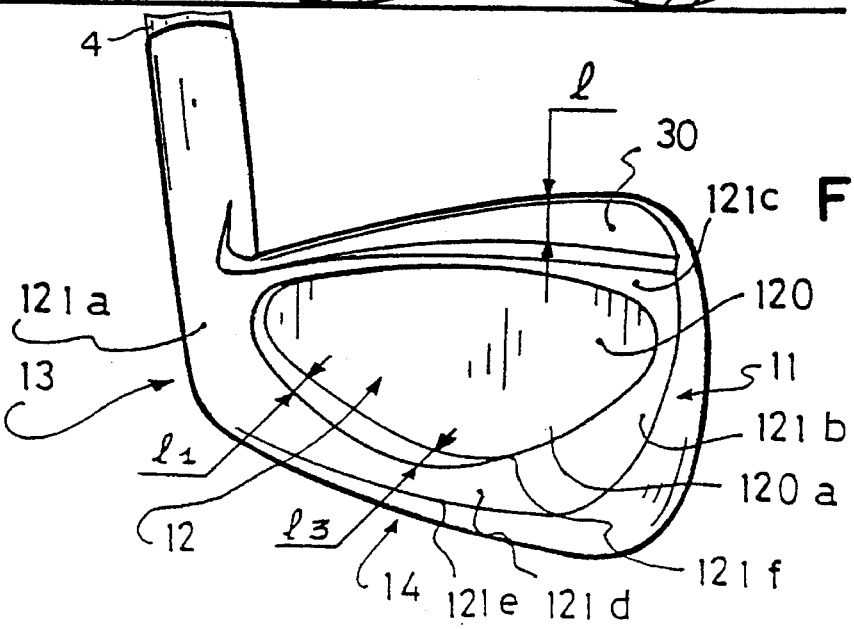
FIG.7

IRON WITH IMPROVED MASS DISTRIBUTION

BACKGROUND OF THE INVENTION

1. Field of the Invention

The present invention relates to an improved golf club head and, more specifically, a club head of the "iron" type, having an improved mass distribution. Further, the invention is directed to a golf club having such a head.

2. Description of Background and Relevant Information

Most modern golf club heads of the "iron" type have a rear cavity thereby creating a substantial peripheral mass distribution. Clubs of this type have won the confidence of golfers and have gradually replaced the old blade-shaped irons, which are much less forgiving and which are therefore mostly used by more experienced players.

Examples of "cavity back" irons having such a mass distribution are described in U.S. Pat. Nos. 5,014,993; 5,242,167; and 5,393,113.

A new level in club head design has been achieved recently by combining a peripheral mass distribution with an oversized head. This leads both to maximizing the inertia and increasing the size of the "sweet spot". By increasing the inertia, the rotation strength of the head is increased during off-center shots and a satisfactory ball trajectory is thereby maintained.

Nevertheless, numerous tests have made it possible to determine that it is important to adjust precisely the position of the center of gravity in order to control perfectly the trajectory of the ball and to avoid lateral deviations of the ball. In particular, it has been found that most irons provided with a peripheral mass distribution combined with an enlarged impact surface have a trajectory with a clear tendency to deviate from left to right (i.e., a slice) for a right-handed golfer.

That tendency has made it possible to show that lowering the center of gravity with respect to the impact face provides the golfer with a better "touch" on the ball and it increases the back-spin necessary for the ball to be able to fly properly along a desired trajectory and for the player to work the ball sufficiently and give it the desired effect, such as a more or less pronounced tendency for the ball to "back-up" once it lands on the green, for example.

Likewise, it has proven important that the position of the center of gravity comes closer to the heel to correct the ball's natural tendency to move towards the right and which becomes accentuated particularly as the golfer selects a club from among the long irons (from a No. 1 to a No. 3 iron, in particular). It has been noted in fact that the position of the center of gravity of a club head is closely correlated with the direction of the trajectory taken by the ball. In short, one can say that the ball goes where the center of gravity is positioned.

For the heads of most irons whose impact surfaces are enlarged or oversized, it has been found necessary to correct the position of the center of gravity in order to adjust perfectly the trajectory of the ball. This correction is not to be made to the detriment of either the important inertia values obtained, or to the general shape of the head, in order not to disturb the player's confidence in his/her golf game. In particular, the head should have a normal appearance when the club is positioned at address, with an upper edge portion of the club head having a standard appearance and size so as not to disturb the golfer.

SUMMARY OF THE INVENTION

An object of the present invention is to propose a solution that enables an optimum adjustment of the position of the center of gravity towards the bottom and towards the heel, while preserving the advantages of a peripheral mass distribution. Another object of the invention is to maintain a normal appearance of the head at address.

To this end, the invention is related to an iron type golf club head including:

a front portion adapted to strike the golf ball;

a toe portion;

a sole portion adapted to rest on the ground at address;

an upper edge portion;

a heel portion possibly extended by a hosel;

a rear portion having a main cavity that extends inwardly toward the front portion, surrounded by a peripheral mass belt defining heel, toe, upper, and lower perimeter portions.

The upper perimeter portion of the peripheral belt includes a secondary recess with a volume that is smaller than that of the main cavity and that increases in the direction of the toe. Thus, without affecting the peripheral overall mass distribution which provides a substantial head inertia, the position of the center of gravity can be adjusted precisely by providing a gradual lightening of the upper portion of the peripheral edge towards the toe, with the result of displacing the center of gravity towards the bottom and the heel of the club head.

According to a complementary characteristic, the thickness of the upper perimeter portion is greater than the thickness, measured at all points, of the distance separating the bottom of the recess from the front portion of the club head. Thus, the head has an appearance that can be compared to that of the standard head when the club is positioned at address. In particular, the upper edge portion has a thickness that is sufficiently pronounced and does not disturb the golfer.

BRIEF DESCRIPTION OF THE DRAWINGS

Other characteristics and advantages of the invention will become apparent from the following description with reference to the non-limiting, annexed drawings and wherein:

FIG. 3 is a rear elevation view of an iron type golf club head according to the invention;

FIG. 4 is an end elevation view in section taken along line 4—4 in FIG. 3;

FIG. 5 is an end elevation view in section taken along line 5—5 in FIG. 3;

FIG. 6 is an end elevation view in section taken along line 6—6 in FIG. 3;

FIG. 6A illustrates a detail of FIG. 6;

FIG. 7 is a rear perspective view of the golf club head of FIG. 3;

DETAILED DESCRIPTION OF PREFERRED EMBODIMENTS

Figure 1:
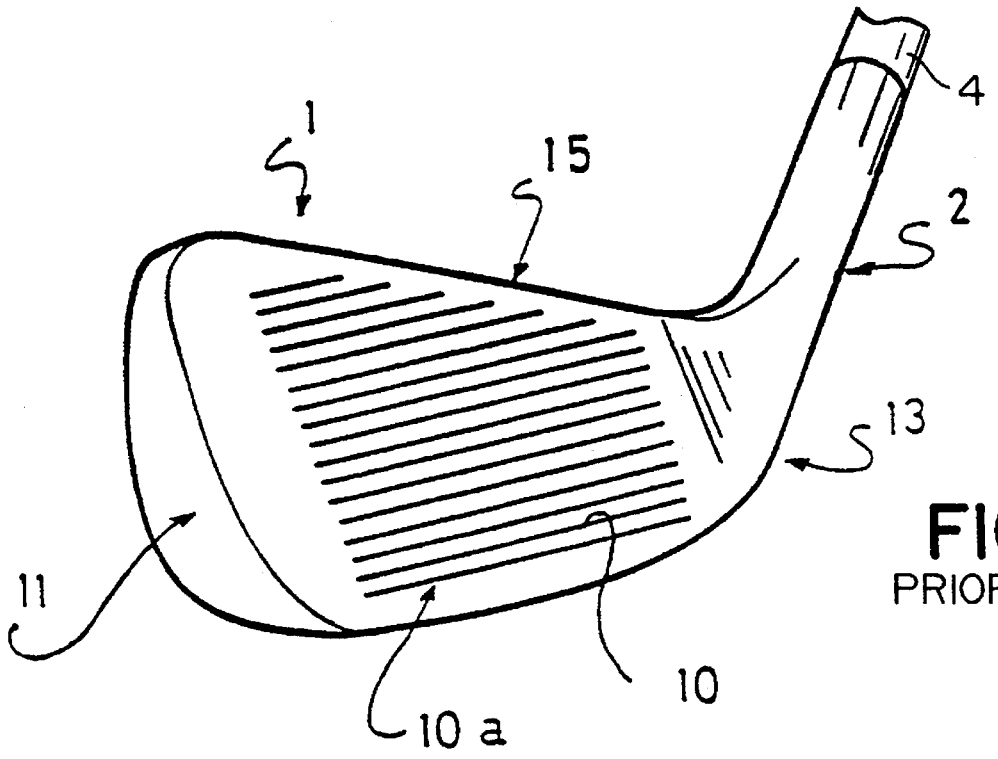
FIG.1 PRIOR ART
FIG. 1 is a perspective view of an iron according to the prior art.
Figure 2:
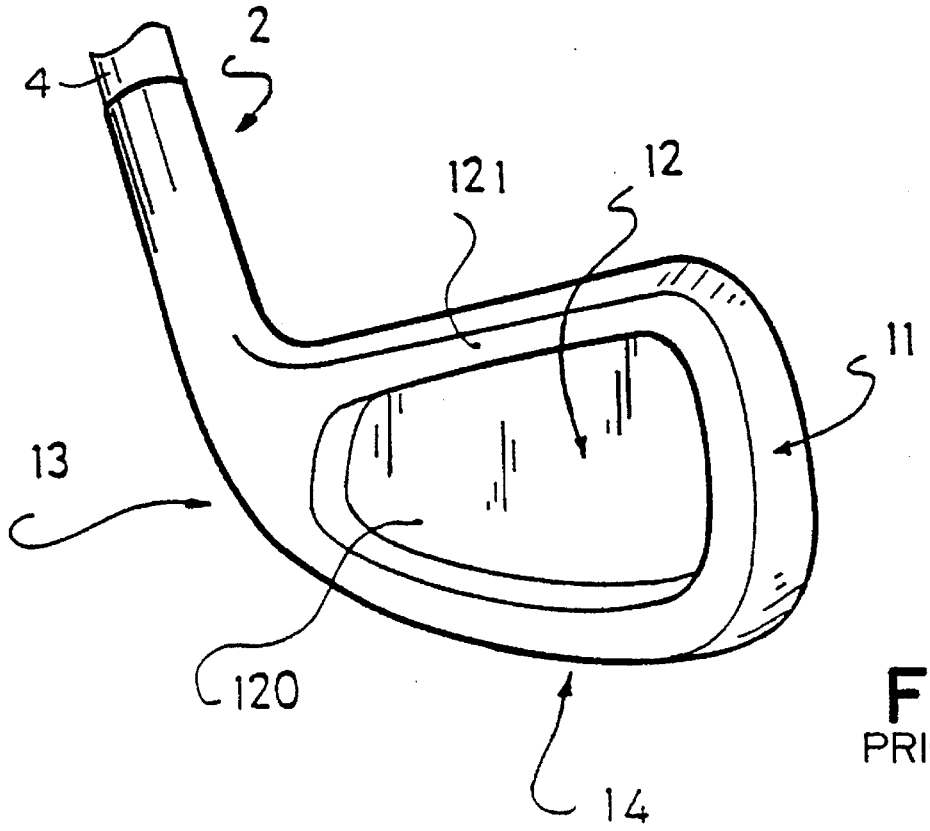
FIG.2 PRIOR ART
FIG. 2 is a rear perspective view of the golf club head of FIG. 1.

FIGS. 1 and 2 illustrate a prior art golf club head of the iron type, which includes a body 1 and a hosel 2 extending therefrom. Of course, the shaft 4 extends from the hosel. The body 1 has a striking or impact surface 10, generally traversed by scoring lines 10*a*, a toe 11 having a substantially triangular shape, a rear portion 12, a heel 13, a sole 14, and finally an upper edge portion 15.

The rear portion 12 comprises a cavity 120 surrounded by a peripheral belt 121 which forms a continuous extent of mass connecting the various portions 12, 13, 14, and 15 of the club head.

FIGS. 3–7 illustrate an example of the iron type club head according to the invention. The references to the various portions 10, 11, 12, 13, 14, and 15 remain identical. The rear portion 12 of the head is provided with a main cavity 120 bordered by a peripheral belt 121 composed of a heel perimeter portion 121*a*, a toe perimeter portion 121*b*, an upper perimeter portion 121*c*, and a lower perimeter portion 121*d*. These portions join to form a continuous belt of mass. One of the primary features of the invention lies in the fact that the upper edge portion includes a secondary recess 3 whose volume is less than the volume of the main cavity 120, but which increases in the direction of the toe of the club head. That is, the volume of the recess 3 per unit length increases toward the toe. In the example shown, the recess extends from the vicinity of the heel 13 to the vicinity of the toe.

The transverse cross sections of FIGS. 4–6 show the gradual increase in the size of the recess 3 along the width of the club head. FIG. 4 is a cross section taken at line 4—4 of FIG. 3 in the area of the heel at about 30 mm (millimeters) from the center of the impact or striking surface (FC).

FIG. 5 is a cross section taken at line 5—5 in the area of the center of the impact surface (FC). FIG. 6 is a cross section taken at line 6—6 in the area of the toe at about 30 mm from the impact surface (FC).

FIG. 3 shows that the shape of the recess 3 thus created shifts the center of gravity (CG) towards the bottom and towards the heel with respect to the center of the impact surface (FC).

Figure 8:
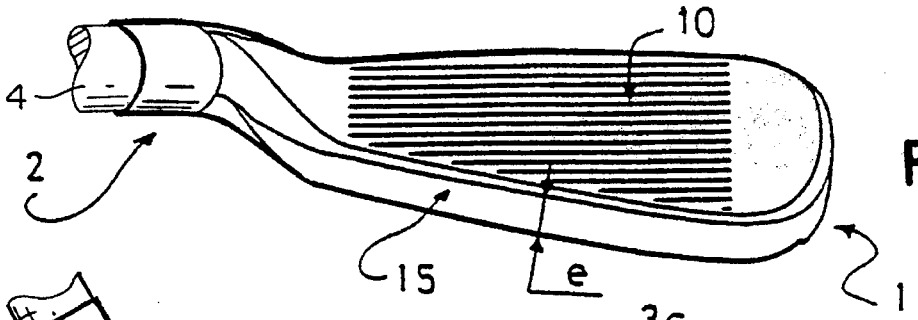
FIG. 8 is a top plan view of the golf club head of FIG. 3, illustrating the visual aspect of the head at address.

As shown in detail in FIGS. 6A and 8, the thickness e of the upper edge portion 15 of the club head is sufficiently maintained to ensure an unchanged appearance of the head compared to that of the prior art. As can been seen in both FIGS. 6*a* and 8, the thickness e of the upper edge portion 15 is measured at the upper end of the striking face 10. The thickness e1 separating the bottom of the recess 3 and the striking face of the front portion 10 is, at all points, less than the thickness e at the top surface of the upper edge portion 15.

On the one hand, the bottom of the recess 3 is progressively connected to the upper edge portion 15 along a first connecting surface 30, whose thickness with respect to the striking face 10 increases progressively. This characteristic imparts a sufficient stiffness to the upper perimeter portion 121*c*. In fact, the surface 30 is slightly inclined downwardly and inwardly with respect to the plane P of the front portion. This surface can be planar or slightly curved, convex or concave.

On the other hand, the bottom of the recess 3 is connected to the rear surface of perimeter portion 121*c* by a shoulder 31 forming a more marked transition. A slight radius 32 connects the first surface 30 to the shoulder 31 to avoid the creation of an area of stress that might be capable of causing a rupture in the event of violent shock to the upper edge of the club head.

As is shown in FIG. 7, the increase in the volume of the recess 3 results from the increases in the height e of the connecting surface in a direction toward the toe.

The main cavity 120 is defined by a bottom surface 120*a* constituted by a substantially planar surface. The thickness e2 between the bottom surface 120*a* and the striking face 10 increases progressively from top to bottom. As a result, this contributes to lower the center of gravity (CG) a small amount towards the bottom without generally modifying the behavior of the striking face. The thickness variation is in the range of 0.5 mm to 2.0 mm.

The gain in mass due to the provision of the variable volume secondary recess 3 is on the order of about 3 g (grams) to 15 g for a total head mass on the order of 230 g to 300 g, depending on the number selected. This leads to a displacement of the center of gravity in the range of 0 mm to 1 mm on the abscissa (horizontal) and of 0 mm to 2 mm on the ordinate (vertical) with respect to the position of the center of the impact face (FC).

It is important to maintain an upper perimeter portion 121*c* having a sufficient thickness in order to guarantee a certain stiffness in the face and to ensure a distribution of the peripheral mass to increase the inertia and the sweet spot. The secondary recess functions as a means for adjusting the center of gravity without affecting, or at least by influencing as little as possible, the advantageous characteristics that are attributable to the construction of "perimeter weighting" of the iron.

The lower perimeter portion 121*d* converges with the sole portion 14 to define a converging edge 121*e*. The converging edge 121*e* has a smaller concavity than the concavity of the connecting edge 121*f* between the lower perimeter portion 121*d* and the main cavity 12 so as to compensate, at least partially, for the mass loss due to the edge widths e1 and e2 at the heel and at the toe, respectively, and smaller than the width e3 at the center of the lower perimeter portion. All of this contributes to the objective of providing an optimum peripheral mass distribution which facilitates the performance of the head in terms of tolerance, sensation at impact, and trajectory.

Figure 9:
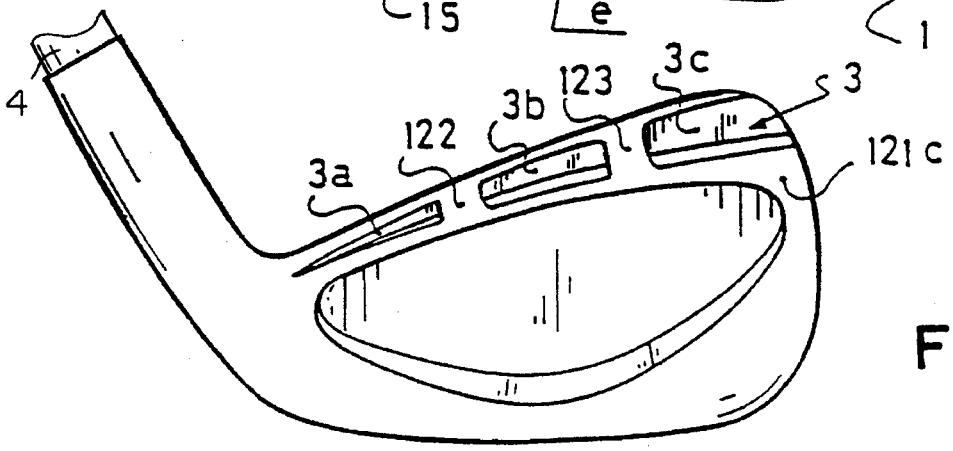
FIG. 9 is a rear elevation view of a golf club head according to an alternative embodiment.
Figure 10:
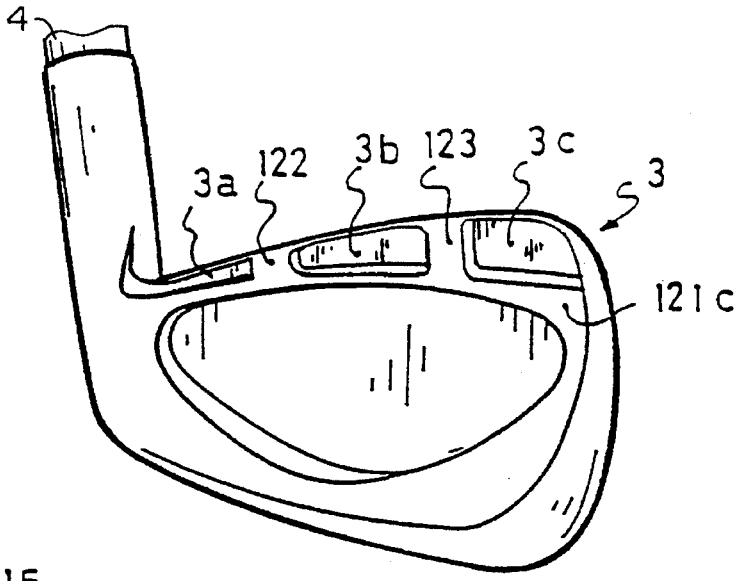
FIG. 10 is a rear perspective view of the head of FIG. 9.

FIGS. 9 and 10 illustrate an alternative embodiment of the invention in which the secondary recess is traversed by a plurality of reinforcement ribs 122,123, which join the upper perimeter portion 121*c* at the upper edge portion 15, thus separating the recess in three parts 3*a*, 3*b*, 3*c*. The volume of the recess generally decreases in a direction toward the toe as in the preceding case.

Figure 11:
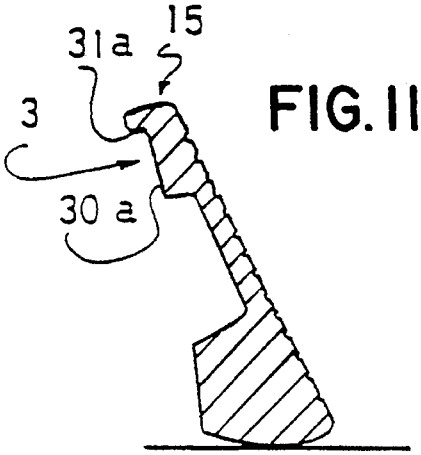
FIG. 11 is a view similar to that of FIG. 6 according to another alternative embodiment.
Figure 12:
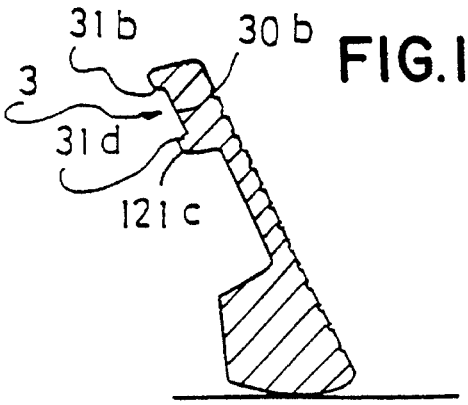
FIG. 12 is a view similar to that of FIG. 6 according to another alternative embodiment.

FIGS. 11 and 12 provide two examples of alternative sectional forms of the secondary recess 3 that can be adopted. In the case of FIG. 11, the bottom of the recess is progressively joined to the upper edge of the mass belt via a progressive slope 30*a* without a clearly defined demarcating zone. Likewise, the bottom is joined to the upper edge portion 15 through a more marked edge or shoulder 31*a*. The transition between the slope 30*a* and the edge 31*a* can have a slight radius.

In the alternative embodiment of FIG. 12, the recess 3 comprises a bottom 30*b* and two edges 31*b*, 31*d* respectively joining the upper edge portion 15 and the upper perimeter portion 121*c* of the mass belt.

In addition, it is contemplated that the main cavity 120 is not bordered by a continuous mass belt, but rather by distinct edges generally forming a non-continuous mass belt where the peripheral distribution is equally preserved. It is understood that such an alternative is an integral part of the invention.

The embodiments presented can be easily and economically constructed by any suited molding process known in the art.

Further, other processes such as forging or the like can be utilized. The head can be made from materials that are commonly used, such as steel, copper, titanium, and their alloys. It is also possible to manufacture certain portions, in particular the peripheral edges, of a high density material and other portions (for example: hosel, face . . . ) in a relatively lower density material.

The invention is particularly suited for irons in which the impact face is enlarged or oversized. It is also contemplated that the invention can be utilized with heads of a normal size.

The invention is not limited to the embodiments thus described and illustrated, but also encompasses all of the equivalents that may be found within the scope of the claims that follow.

What is claimed is:

1. An iron type golf club head comprising:

a face portion including a golf ball striking surface;

a toe;

a sole adapted to rest on the ground at address;

an upper edge portion;

a heel;

a rear portion having a main cavity extending towards said face portion and a peripheral mass belt extending around said main cavity defining a heel perimeter portion, a toe perimeter portion, an upper perimeter portion, and a lower perimeter portion, said main cavity having a predeterminate volume;

said upper perimeter portion of said peripheral mass belt comprising a secondary recess, said secondary recess having a volume smaller than said predeterminate volume of said main cavity and a volume per unit length that increases in a direction toward said toe of the club head;

said recess having a bottom, said recess bottom being a portion of said recess closest to said striking surface to thereby define a predeterminate thickness of the club head between said bottom and striking surface; and said upper edge portion having a thickness extending from said striking surface, measured at an upper end of said striking surface, to said rear portion of the golf club head, said thickness of said upper edge portion being greater than said predeterminate thickness, measured at all points along said recess bottom.

2. A golf club head according to claim 1, wherein:

said recess bottom being joined to said upper edge portion along a connecting surface to thereby define a thickness of the club head between said connecting surface and said striking surface, said thickness gradually increasing in a direction toward said upper edge portion; and said recess bottom being joined to a rear surface of said upper perimeter portion through a shoulder.

3. A golf club head according to claim 2, wherein:

said connecting surface has a width that increases progressively along the cavity in a direction toward said toe.

4. An iron type golf club head comprising:

a face portion including a golf ball striking surface;

a toe;

a sole adapted to rest on the ground at address;

an upper edge portion;

a heel;

a rear portion having a main cavity extending towards said face portion and a peripheral mass belt extending around said main cavity defining a heel perimeter portion, a toe perimeter portion, an upper perimeter portion, and a lower perimeter portion, said main cavity having a predeterminate volume;

said upper perimeter portion of said peripheral mass belt comprising a secondary recess, said secondary recess having a volume smaller than said predeterminate volume of said main cavity and a volume per unit length that increases in a direction toward said toe of the club head;

said recess including a bottom, said recess bottom being joined to said upper edge portion along a connecting surface to thereby define a thickness of the club head between said connecting surface and said striking surface, said thickness gradually increasing in a direction toward said upper edge portion; and said recess bottom being joined to a rear surface of said upper perimeter portion through a shoulder.

5. A golf club head according to claim 4, wherein:

said connecting surface has a width that increases progressively along the cavity in a direction toward said toe.

6. A golf club head according to claim 1, further comprising:

a hosel extending from the heel portion.

7. An iron type golf club head comprising:

a face portion including a golf ball striking surface;

a toe;

a sole adapted to rest on the ground at address;

an upper edge portion;

a heel;

a rear portion having a main cavity extending towards said face portion and a peripheral mass belt extending around said main cavity defining a heel perimeter portion, a toe perimeter portion, an upper perimeter portion, and a lower perimeter portion, said main cavity having a predeterminate volume;

said upper perimeter portion of said peripheral mass belt comprising a secondary recess, said secondary recess having a volume smaller than said predeterminate volume of said main cavity and a volume per unit length that increases in a direction toward said toe of the club head;

said main cavity comprising a cavity bottom having a substantially planar surface to thereby define a thickness with said striking surface that increases in a direction toward said sole.

8. A golf club head according to claim 7, wherein:

said lower perimeter portion and said sole define a first converging edge and said lower perimeter portion and said main cavity define a second converging edge; and said first converging edge has a concavity less than a concavity of said second converging edge.

9. A golf club comprising:

an iron type golf club head comprising:

a face portion including a golf ball striking surface;

a toe;

a sole adapted to rest on the ground at address;

an upper edge portion;

a heel;

a rear portion having a main cavity extending towards said face portion and a peripheral mass belt extending around said main cavity defining a heel perimeter portion, a toe perimeter portion, an upper perimeter portion, and a lower perimeter portion, said main cavity having a predeterminate volume;

said upper perimeter portion of said peripheral mass belt comprising a secondary recess, said secondary recess having a volume smaller than said predeterminate volume of said main cavity and a volume per unit length that increases in a direction toward said toe of the club head;

said recess having a bottom, said recess bottom being a portion of said recess closest to said striking surface to thereby define a predeterminate thickness of the club head between said bottom and said striking surface;

said upper edge portion having a thickness extending from said striking surface, measured at an upper end of said striking surface, to said rear portion of the golf club head, said thickness of said upper edge portion being greater than said predeterminate thickness, measured at all points along said recess bottom; and a shaft extending from the golf club head.

10. An iron type golf club head comprising:

a face portion including a golf ball striking surface;

a toe;

a sole adapted to rest on the ground at address;

an upper edge portion;

a heel;

a rear portion having a main cavity extending towards said face portion and a continuous peripheral mass belt extending around said main cavity defining a heel perimeter portion, a toe perimeter portion, an upper perimeter portion, and a lower perimeter portion, said main cavity having a predeterminate volume;

said rear portion having a secondary recess positioned above said main cavity, said secondary recess having a volume smaller than said predeterminate volume of said main cavity and a volume per unit length that increases in a direction toward said toe of the club head;

said recess having a bottom, said recess bottom being a portion of said recess closest to said striking surface to thereby define a predeterminate thickness of the club head between said bottom and said striking surface; and said upper edge portion having a thickness extending from said striking surface, measured at an upper end of said striking surface, to said rear portion of the golf club head, said thickness of said upper edge portion being greater than said predeterminate thickness, measured at all points along said recess bottom.

11. A golf club head according to claim 10, wherein:

at least a portion of said upper perimeter portion is located between said secondary recess and said main cavity.

* * * * *